US009168578B2

(12) United States Patent
Yoon

(10) Patent No.: US 9,168,578 B2
(45) Date of Patent: Oct. 27, 2015

(54) HOT STAMPING MOLD

(71) Applicant: Hyundai Motor Company, Seoul (KR)

(72) Inventor: Kyoung Won Yoon, Whasung-Si (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 67 days.

(21) Appl. No.: 14/089,451

(22) Filed: Nov. 25, 2013

(65) Prior Publication Data

US 2014/0260493 A1 Sep. 18, 2014

(30) Foreign Application Priority Data

Mar. 15, 2013 (KR) ..... 10-2013-0027959

(51) Int. Cl.
*B21D 22/02* (2006.01)
*B21D 37/16* (2006.01)

(52) U.S. Cl.
CPC ..... *B21D 22/022* (2013.01); *B21D 37/16* (2013.01)

(58) Field of Classification Search
CPC ..... B21D 22/02; B21D 22/022; B21D 37/16; B21D 24/16; B21J 1/06; B21K 29/00
USPC ..... 72/342.1–342.94
See application file for complete search history.

(56) References Cited

U.S. PATENT DOCUMENTS

| | | | | |
|---|---|---|---|---|
| 3,340,714 | A * | 9/1967 | Pohl et al. | 72/342.4 |
| 3,703,093 | A * | 11/1972 | Komatsu et al. | 72/342.4 |
| 2008/0184763 | A1 * | 8/2008 | Schroth et al. | 72/342.1 |

FOREIGN PATENT DOCUMENTS

| | | | |
|---|---|---|---|
| JP | 06-285700 | A | 10/1994 |
| JP | 2005-205416 | A | 8/2005 |

* cited by examiner

*Primary Examiner* — Theresa M Ekiert
(74) *Attorney, Agent, or Firm* — Morgan, Lewis & Bockius LLP

(57) ABSTRACT

A hot stamping mold apparatus may include a bottom part equipped on a bolster and a top part equipped on a slider, wherein the bottom part and the top part each include a cooling mold including a plurality of coolant chambers formed therein, a heating mold installed at a side of the cooling mold to form a formed surface together with the cooling mold and provided with a heating cartridge installed at a side of the heating mold, and a plurality of insert blocks interposed between the cooling mold and the heating mold.

19 Claims, 3 Drawing Sheets

HOT STAMPING MOLD

CROSS-REFERENCE TO RELATED APPLICATION

The present application claims priority to Korean Patent Application No. 10-2013-0027959 filed on Mar. 15, 2013, the entire contents of which is incorporated herein for all purposes by this reference.

BACKGROUND OF THE INVENTION

1. Field of the Invention

The present invention relates to a hot stamping mold. More particularly, the present invention relates to a hot stamping mold having both a high strength unit and a low strength unit to produce formed goods.

2. Description of Related Art

Typically, efforts have been made to improve both a reduction in weight and collision safety of a vehicle body in a vehicle industry.

Recently, as shown in FIG. 1, a hot stamping technology that is a hot press forming technology using a steel sheet 111 (particularly, boron steel sheet) has been actively researched in order to satisfy both hardness and a reduction in weight of a steel sheet material.

That is, the hot stamping technology is a forming technology of heating the steel sheet 111 to an appropriate temperature to perform forming in a press mold 113 using press forming at a time and then performing quenching to manufacture high strength parts 115.

Accordingly, hot stamping formed goods may have strength that is four or five times higher than that of typical steel sheet parts and a weight reduced by 40% at most as compared to the typical steel sheet parts. Therefore, as described above, there is a merit in that both the reduction in weight and strength of the vehicle body can be improved.

Meanwhile, recently, formed goods having both a high strength unit and a low strength unit with a transition segment interposed therebetween have been produced by partially heating a steel sheet in a mold to perform forming.

As described above, the hot stamping forming technology enabling the formed goods to have both the high strength unit and the low strength unit may satisfy the reduction in weight of the vehicle body and partially secure both collision absorption performance and hardness to improve safety.

An example of application of the hot stamping forming technology may include a center filler 100 of the vehicle body shown in FIG. 2.

That is, in the case of the center filler 100, it is ideal that a bottom unit directly receiving an effect of collision be formed of a low strength unit L to improve collision absorption performance and a top unit slightly receiving an effect of direct collision be formed of a high strength unit H so as to maintain an entire frame of the vehicle body, thus improving hardness.

As described above, the formed goods having both the high strength unit H and the low strength unit L are partially heated in the mold. Accordingly, there are drawbacks in that the transition segment TS between the high strength unit H and the low strength unit L is widely distributed and a position of the transition segment TS is not uniform due to adiabatic inferiority of the mold and thermal expansion of the mold.

The drawbacks make it difficult to satisfy design specs of segments of the high strength unit H and the low strength unit L of the formed goods and to minimize the transition segment TS.

Further, there is a drawback in that dimensional precision of the formed goods is poor due to thermal expansion of the mold.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a hot stamping mold uniformizing and minimizing a transition segment between a high strength unit and a low strength unit.

Further, various aspects of the present invention are directed to providing a hot stamping mold in which a position change of the mold due to thermal expansion is suppressed to improve dimensional precision of formed goods.

In an aspect of the present invention, a hot stamping mold apparatus may include a bottom part equipped on a bolster and a top part equipped on a slider, wherein the bottom part and the top part each may include a cooling mold including a plurality of coolant chambers formed therein, a heating mold installed at a side of the cooling mold to form a formed surface together with the cooling mold and provided with a heating cartridge installed at a side of the heating mold, and a plurality of insert blocks interposed between the cooling mold and the heating mold.

In the cooling mold and the heating mold, an air adiabatic layer is formed between internal sides corresponding to each other of the cooling mold and the heating mold.

The air adiabatic layer is formed with a predetermined gap between an internal side of the cooling mold and an internal side of the heating mold corresponding to the internal side of the cooling mold.

The coolant chambers are formed so that a portion of the plurality of coolant chambers is adjacent to the insert blocks in the cooling mold.

The heating cartridge may include a temperature sensor sensing a temperature of the heating mold and outputting a temperature signal.

The heating cartridge may include a plurality of heating coils installed in the heating mold.

The plurality of insert blocks is inserted into the cooling mold and a contacting surface of the insert blocks comes into contact with the heating mold to support the heating mold.

The plurality of insert blocks forms a heat insulating space between the cooling mold and the heating mold by supporting the heating mold away from the cooling mold.

The insert blocks are formed of an adiabatic material.

The hot stamping mold apparatus may further include a position pin installed between the cooling mold and the heating mold to hold the cooling mold and the heating mold.

The position pin is installed between the cooling mold and the heating mold while being adjacent to an air adiabatic layer.

The position pin is fitted into pin holes formed in the cooling mold and the heating mold.

According to the exemplary embodiment of the present invention, thermal conduction between a heating mold and a cooling mold is suppressed by an insert block and an air adiabatic layer. Therefore, a transition segment on formed goods corresponding to the air adiabatic layer can be reduced and a position can be uniformized.

Further, the region and the position of the transition segment can be uniformized. Therefore, a high strength unit and a low strength unit of the formed goods can be precisely formed according to dimensions of a design.

Further, deformation of the entire mold can be prevented by regulating a position of the thermally expanded heating mold using a position pin. Accordingly, dimensional precision of the formed goods can be increased.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
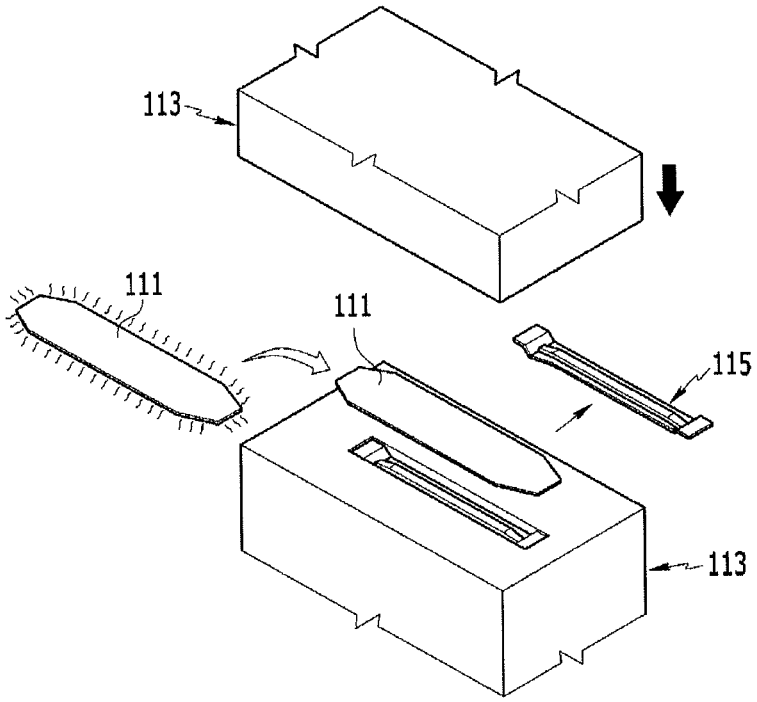
FIG.1 (Related Art)
FIG. 1 is a conceptual view of a typical hot stamping process.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Hereinafter, exemplary embodiments of the present invention will be described in detail with reference to the accompanying drawings.

However, the size and thickness of each element shown in the drawings are arbitrarily shown for understanding and ease of description, but the present invention is not limited thereto. The thickness of portions and regions are exaggerated for clarity.

Figure 2:
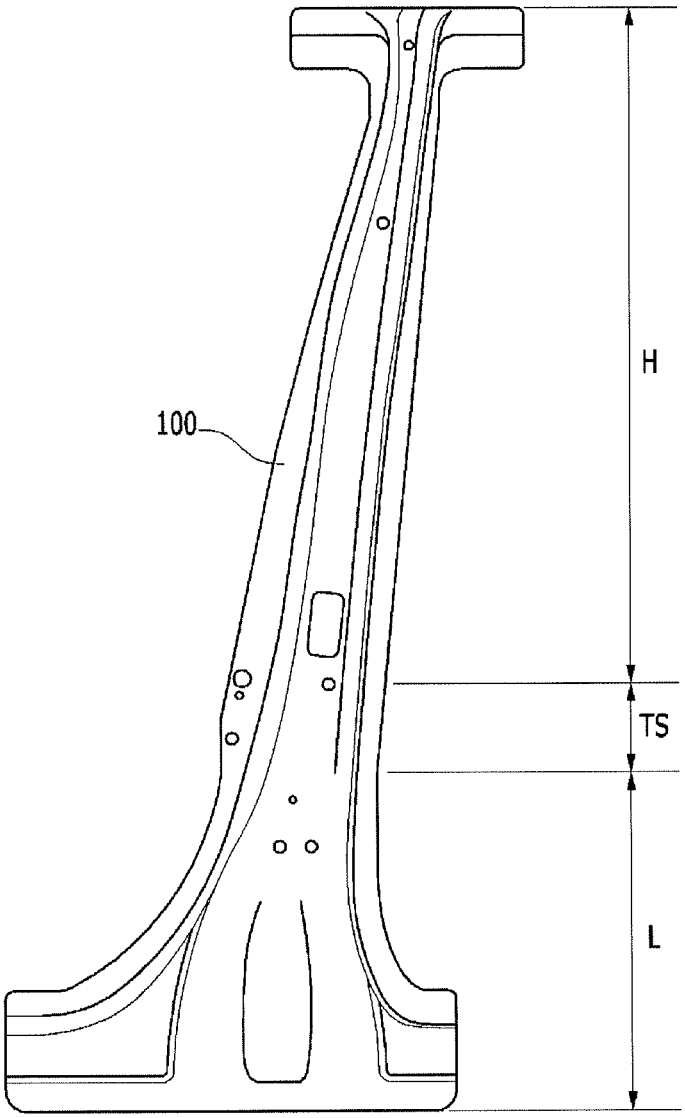
FIG. 2 is a side view of a center filler of an example of typical hot stamping formed goods.
Figure 3:
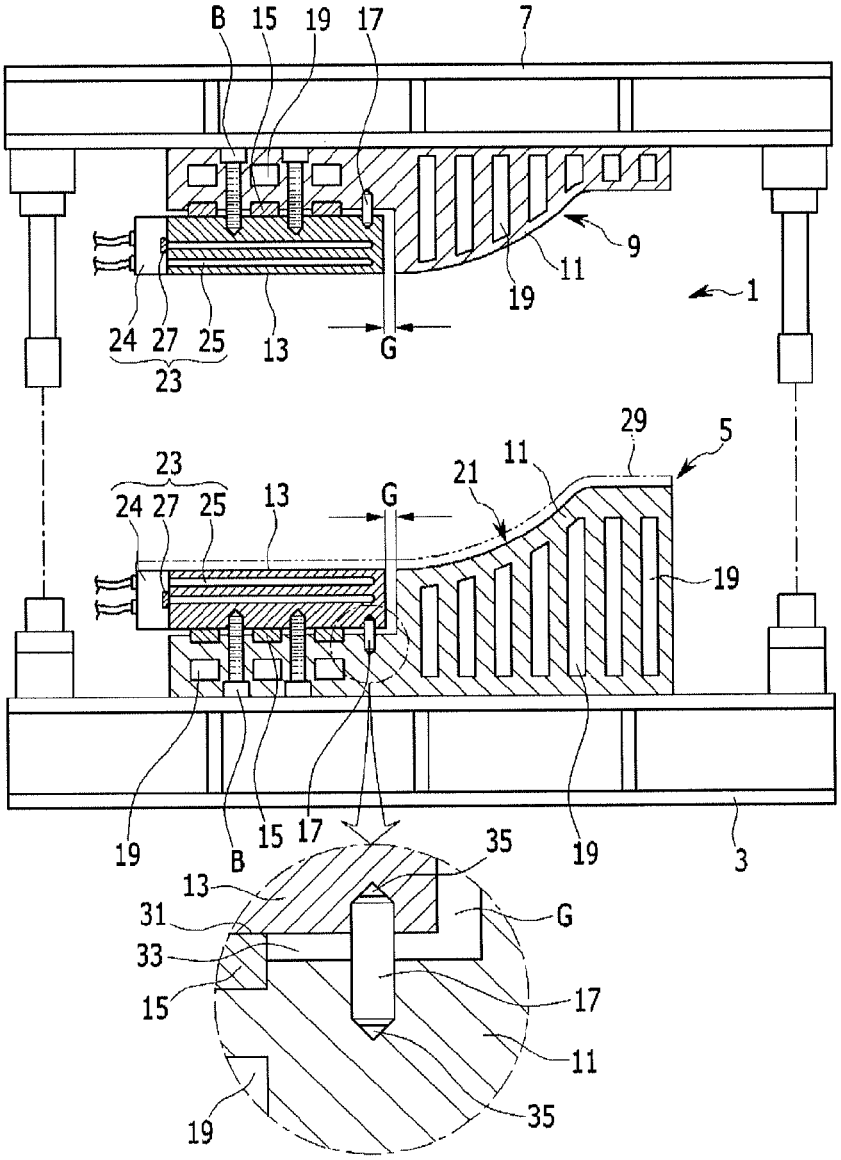
FIG. 3 is a cross-sectional side view of a hot stamping mold according to an exemplary embodiment of the present invention.

FIG. 2 is a side view of a center filler of an example of typical hot stamping formed goods. FIG. 3 is a cross-sectional side view of a hot stamping mold according to an exemplary embodiment of the present invention.

Referring to FIG. 2, a center filler 100 of a vehicle body is disclosed as an example of formed goods formed through a hot stamping mold 1 according to the exemplary embodiment of the present invention.

In the case of the center filler 100, a bottom unit directly receiving an effect of collision is formed of a low strength unit L and a top unit slightly receiving an effect of direct collision is formed of a high strength unit H. A transition segment TS is formed between the high strength unit H and the low strength unit L.

Referring to FIG. 3, in the hot stamping mold 1 according to the exemplary embodiment of the present invention, a material 29 is partially heated to form the formed goods having the high strength unit H and the low strength unit L with the transition segment TS interposed therebetween.

The hot stamping mold 1 includes a bottom part 5 equipped on a bolster 3 and a top part 9 equipped on a slider 7.

The bottom part 5 and the top part 9 are each divided into a cooling mold 11 and a heating mold 13 and each include an insert block 15 and a position pin 17.

A plurality of coolant chambers 19 is formed in the cooling mold 11. The heating mold 13 engages with a side of the cooling mold 11 by a bolt B and forms a formed surface 21 together with the cooling mold 11.

In addition, a plurality of insert blocks 15 is interposed between the cooling mold 11 and the heating mold 13. The position pin 17 is installed at sides of the cooling mold 11 and the heating mold 13.

Hereinafter, a more specific constitution of the hot stamping mold 1 will be described.

The coolant chamber 19 formed in the cooling mold 11 circulates a coolant supplied from an external coolant supply unit to maintain the cooling mold 11 at a predetermined temperature, for example, about 20° C.

In addition, a heating cartridge 23 is connected to the heating mold 13.

The heating cartridge 23 includes a plurality of modulated heating coils 25 installed in the heating mold 13, and is fixed to an external side of the heating mold 13 through an installation block 24.

The heating cartridge 23 includes a temperature sensor 27 sensing a temperature of the heating mold 13 and outputting a temperature signal.

Further, the heating cartridge 23 is electrically connected to a controller together with the temperature sensor 27 and power is supplied according to the temperature of the heating mold 13 to maintain the heating mold 13 at a predetermined temperature, for example, about 450° C.

The heating mold 13 is installed at a side of the cooling mold 11 while the insert block 15 is interposed therebetween.

The insert block 15 is installed between the cooling mold 11 and the heating mold 13 and supports the heating mold 13 to the cooling mold 11.

Herein, the insert block 15 may be made of an adiabatic material or a material having low heat transfer coefficient. While the insert block 15 is inserted through a groove into the cooling mold 11, a contacting surface 31 comes into contact with the heating mold 13 to support the heating mold 13.

In this case, a heat insulating space 33 is formed between the cooling mold 11 and the heating mold 13 through the insert block 15.

Meanwhile, a portion of a plurality of coolant chambers 19 is formed in the cooling mold 11 while being adjacent to an installation position of the insert block 15.

In addition, an air adiabatic layer G is formed between internal sides of the cooling mold 11 and the heating mold 13, which correspond to each other.

The air adiabatic layer G is formed with a predetermined gap G between the internal side of the cooling mold 11 and the internal side of the heating mold 13 corresponding thereto.

The air adiabatic layer G is formed to correspond to the transition segment TS in which strength is changed between the high strength unit H and the low strength unit L formed in the formed goods.

In addition, the position pin 17 is installed between the cooling mold 11 and the heating mold 13 while being adjacent to the air adiabatic layer G.

The position pin 17 may be fitted into pin holes 35 formed in the cooling mold 11 and the heating mold 13 at both ends thereof.

In the hot stamping mold 1 having the aforementioned constitution, thermal conduction between the heating mold 13 and the cooling mold 11 is suppressed through the air adiabatic layer G including air having low heat transfer coefficient as a medium to increase an adiabatic property between the molds 11 and 13.

Further, the adiabatic property between the molds 11 and 13 is increased by supporting the heating mold 13 to the cooling mold 11 through the insert block 15 and forming the heat insulating space 33 therebetween to minimize a contact cross-sectional area therebetween.

Further, a forming quality of the formed goods is increased by suppressing a position change due to thermal expansion of the heating mold 13 to the cooling mold 11 using the position pin 17.

Therefore, in the hot stamping mold 1 according to the exemplary embodiment of the present invention, thermal conduction between the heating mold 13 and the cooling mold 11 is suppressed by the insert block 15 and the air adiabatic layer G to increase the adiabatic property between the molds 11 and 13.

This may uniformize the position of the transition segment TS on the formed goods corresponding to the air adiabatic layer G and reduce a region of the transition segment TS.

Further, the region and the position of the transition segment TS are uniformized and the high strength unit H and the low strength unit L of the formed goods are precisely formed according to dimensions of a design to increase dimensional precision of the design of the formed goods.

Further, deformation of the entire mold 1 may be prevented by regulating the position of the thermally expanded heating mold 13 using the position pin 17. Accordingly, a forming inferiority rate of the formed goods may be reduced.

For convenience in explanation and accurate definition in the appended claims, the terms "upper", "lower", "inner" and "outer", are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. They are not intended to be exhaustive or to limit the invention to the precise forms disclosed, and obviously many modifications and variations are possible in light of the above teachings as well as various alternatives and modifications thereof. It is intended that the scope of the invention be defined by the Claims appended hereto and their equivalents.

What is claimed is:

1. A hot stamping mold apparatus including a bottom part equipped on a bolster and a top part equipped on a slider, wherein the bottom part and the top part each include:

a cooling mold including a plurality of coolant chambers formed therein;

a heating mold installed at a side of the cooling mold to form a formed surface together with the cooling mold and provided with a heating cartridge installed at a side of the heating mold; and a plurality of insert blocks interposed between the cooling mold and the heating mold, wherein in the cooling mold and the heating mold, an air adiabatic layer is formed between internal sides corresponding to each other of the cooling mold and the heating mold.

2. The hot stamping mold apparatus of claim 1, wherein the air adiabatic layer is formed with a predetermined gap between an internal side of the cooling mold and an internal side of the heating mold corresponding to the internal side of the cooling mold.

3. The hot stamping mold apparatus of claim 1, wherein the coolant chambers are formed so that a portion of the plurality of coolant chambers is adjacent to the insert blocks in the cooling mold.

4. The hot stamping mold apparatus of claim 1, wherein the heating cartridge includes a temperature sensor sensing a temperature of the heating mold and outputting a temperature signal.

5. The hot stamping mold apparatus of claim 1, wherein the heating cartridge includes a plurality of heating coils installed in the heating mold.

6. The hot stamping mold apparatus of claim 1, wherein the plurality of insert blocks forms a heat insulating space between the cooling mold and the heating mold by supporting the heating mold away from the cooling mold.

7. The hot stamping mold apparatus of claim 1, wherein the insert blocks are formed of an adiabatic material.

8. A hot stamping mold apparatus including a bottom part equipped on a bolster and a top part equipped on a slider, wherein the bottom part and the top part each include:

a cooling mold including a plurality of coolant chambers formed therein;

a heating mold installed at a side of the cooling mold to form a formed surface together with the cooling mold and provided with a heating cartridge installed at a side of the heating mold; and a plurality of insert blocks interposed between the cooling mold and the heating mold, wherein the plurality of insert blocks is inserted into the cooling mold and a contacting surface of the insert blocks comes into contact with the heating mold to support the heating mold.

9. The hot stamping mold apparatus of claim 8, wherein the coolant chambers are formed so that a portion of the plurality of coolant chambers is adjacent to the insert blocks in the cooling mold.

10. The hot stamping mold apparatus of claim 8, wherein the heating cartridge includes a temperature sensor sensing a temperature of the heating mold and outputting a temperature signal.

11. The hot stamping mold apparatus of claim 8, wherein the heating cartridge includes a plurality of heating coils installed in the heating mold.

12. The hot stamping mold apparatus of claim 8, wherein the plurality of insert blocks forms a heat insulating space between the cooling mold and the heating mold by supporting the heating mold away from the cooling mold.

13. The hot stamping mold apparatus of claim 8, wherein the insert blocks are formed of an adiabatic material.

14. A hot stamping mold apparatus including a bottom part equipped on a bolster and a top part equipped on a slider, wherein the bottom part and the top part each include:

a cooling mold including a plurality of coolant chambers formed therein;

a heating mold installed at a side of the cooling mold to form a formed surface together with the cooling mold and provided with a heating cartridge installed at a side of the heating mold;

a plurality of insert blocks interposed between the cooling mold and the heating mold; and a position pin installed between the cooling mold and the heating mold to hold the cooling mold and the heating mold.

15. The hot stamping mold apparatus of claim 14, wherein the position pin is installed between the cooling mold and the heating mold while being adjacent to an air adiabatic layer.

16. The hot stamping mold apparatus of claim 14 wherein the position pin is fitted into pin holes formed in the cooling mold and the heating mold.

17. The hot stamping mold apparatus of claim 14, wherein the coolant chambers are formed so that a portion of the plurality of coolant chambers is adjacent to the insert blocks in the cooling mold.

18. The hot stamping mold apparatus of claim 14, wherein the heating cartridge includes a temperature sensor sensing a temperature of the heating mold and outputting a temperature signal.

19. The hot stamping mold apparatus of claim 14, wherein the heating cartridge includes a plurality of heating coils installed in the heating mold.

* * * * *